US005451841A

United States Patent [19]

Dunn et al.

[11] Patent Number: 5,451,841

[45] Date of Patent: Sep. 19, 1995

[54] SOFT START OF LAMP FILAMENT

[75] Inventors: William R. Dunn, Alpharetta; James E. Strickling, III, Duluth; Joseph W. Goode, III, Lawrenceville, all of Ga.

[73] Assignee: Avionic Displays Corporation, Deluth, Ga.

[21] Appl. No.: 187,876

[22] Filed: Jan. 28, 1994

[51] Int. Cl.[6] ..... H05B 37/00

[52] U.S. Cl. ..... 315/97; 315/291; 315/102; 315/105

[58] Field of Search ..... 315/105, 102, DIG. 7, 315/291, 307, 311, 94, 97, 101, 106, 107

[56] References Cited

U.S. PATENT DOCUMENTS 2,466,053 4/1949 Shaper ..... 315/101
4,255,690 3/1981 Lecornet ..... 315/105
5,015,921 5/1991 Carlson et al. ..... 315/DIG. 7

FOREIGN PATENT DOCUMENTS 470750 2/1992 European Pat. Off. ..... 315/101

*Primary Examiner*—Robert J. Pascal
*Assistant Examiner*—Michael B. Shingleton
*Attorney, Agent, or Firm*—Standley & Gilcrest

[57] ABSTRACT

A method is provided in which a relatively cold lamp filament may be turned on for a brief period of time, then turned off, then turned on again, then off again, and this process repeated for successively longer periods of on time, until eventually the filament power is left on continuously. This "pulse starting" may be controlled by a programmable microcontroller in association with a power supply to the lamp filament. The result is a longer lasting lamp filament.

9 Claims, 2 Drawing Sheets

SOFT START OF LAMP FILAMENT

BACKGROUND AND SUMMARY OF THE INVENTION

The present invention relates generally to fluorescent lamps, and more particularly, to a method for starting a lamp filament, to prolong its life.

The maximum thermal stress of a lamp filament occurs at the moment the lamp is turned on due to the fact that prior to the lamp being turned on it is relatively cold. Under traditional start up of a lamp it is suddenly warmed to a substantially higher temperature. The sudden change in temperature can result in failure of the lamp filament.

It is not uncommon for fluorescent lamps to contain condensed mercury in the filament when the lamp is turned off. When the lamp is turned on the condensed mercury can cause the filament to short out. Furthermore, electrical resistance decreases when the filament is relatively cold. The sudden power surge which is experienced by the lamp when it is turned on can also cause excessive wear and tear on the lamp and filament resulting in failure. Operating temperatures of a filament may reach 11,000° F. and when not in use, in some arctic environments, filaments may be exposed to temperatures as low as minus 54° C.

There exists a need to provide a method in which a lamp may be turned on without inducing the relatively high levels of thermal stress that is common in fluorescent lamps. The method of the present invention uses a "pulse start" duty cycle modulation method in which the lamp is turned on for an instant and then turned off again. This process is repeated several times over a period of a few seconds. Each time the filament is turned on it is allowed to remain on for a relatively longer instant of time, until such time as the filament is powered on continuously. In this manner, the lamp is not experiencing the sudden and continuous high thermal stresses that it otherwise would experience if the filament were turned on and left on continuously during start up. The result is a longer life for a lamp filament using the present invention.

DETAILED DESCRIPTION OF PREFERRED EMBODIMENT(S)

Figure 1:
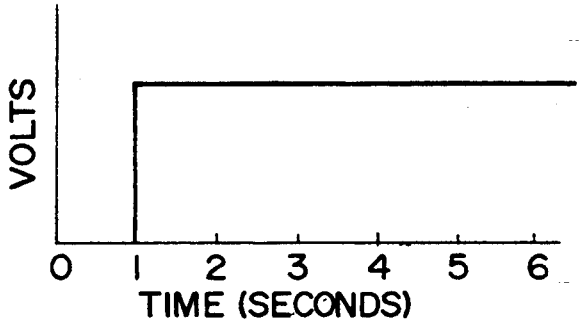
Fig. 1 (PRIOR ART)
FIG. 1 is a graphical depiction of a lamp start up showing the relationship between lamp voltage and time.

Referring to FIG. 1, the traditional manner in which a lamp is turned on is depicted. At time zero there is no voltage applied to the filament. At the time the lamp is to be turned on full voltage is applied and maintained continuously during start up and operation of the lamp.

This known method induces maximum thermal stresses in the lamp, which may result in failure.

Figure 2A:
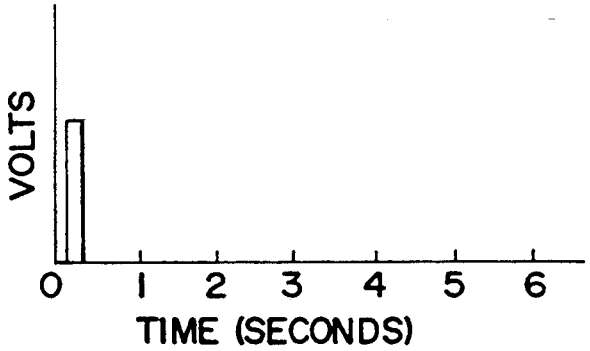
FIGS. 2(A)–(D) are a graphical depiction of a preferred pulse modulation scheme of the present invention which shows lamp voltage versus time at intervals of time 0.1 second, 1 second, 3 seconds, and 8 seconds respectively.
Figure 2B:
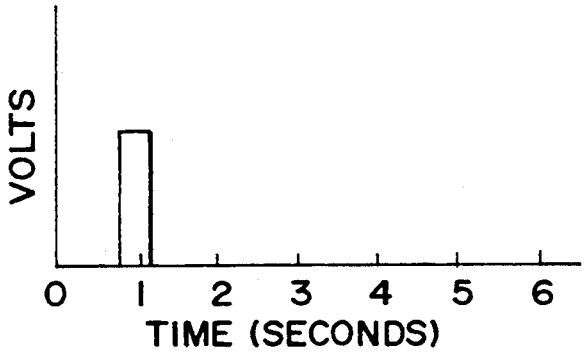
Figure 2C:
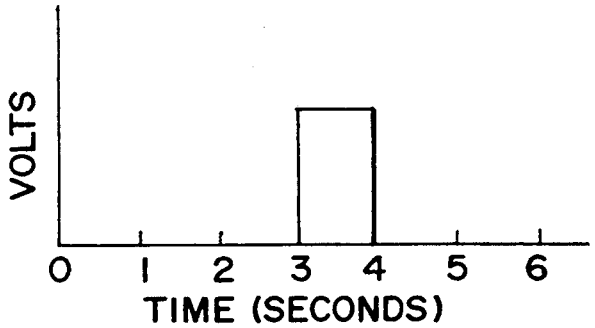
Figure 2D:
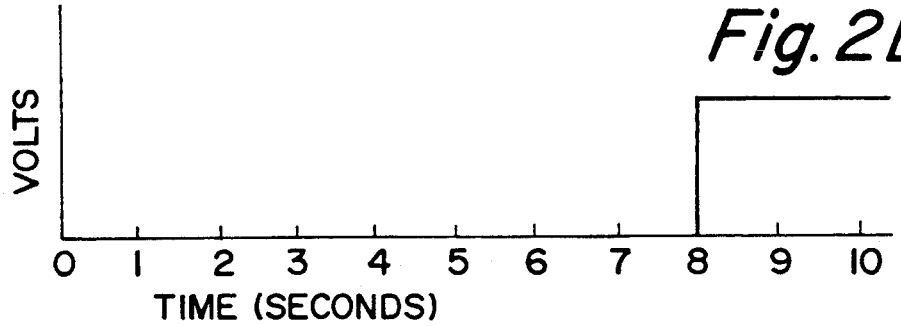
Figure 3:
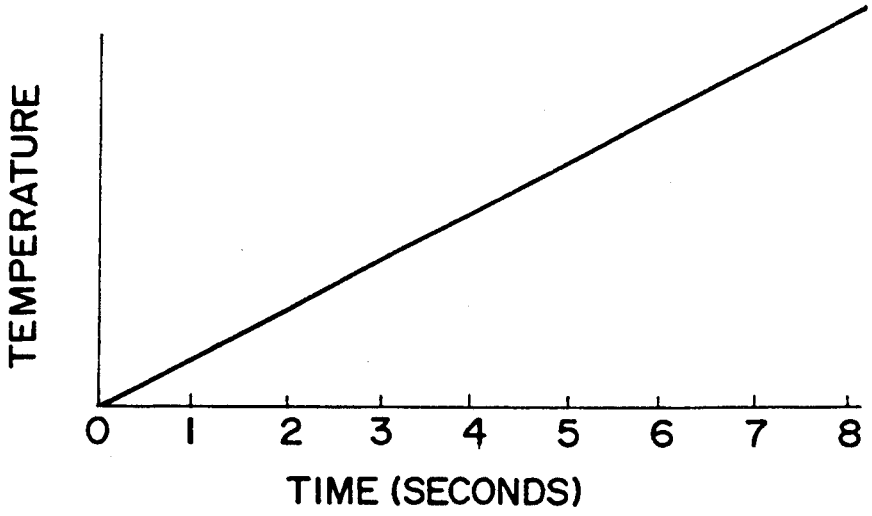
FIG. 3 is a graphical depiction of the net result of the pulse modulation scheme of one embodiment of the present invention in which the full power is continuously maintained after 8 seconds at 4.6 volts.
Figure 4:
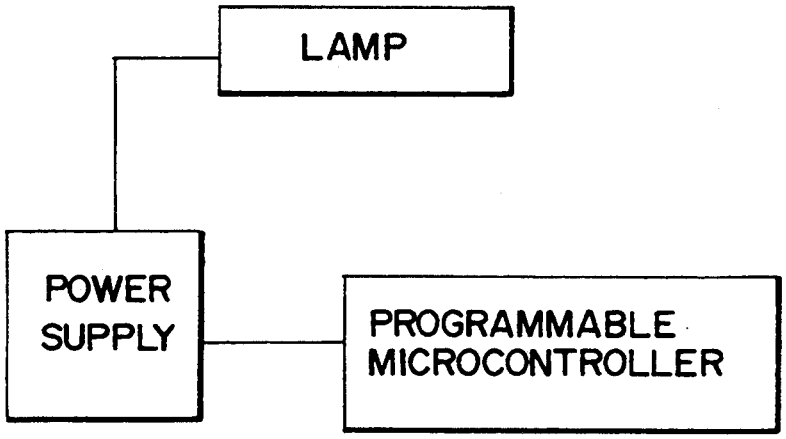
FIG. 4 is a diagrammatical representation of a system to operate the present invention.

The method of the present invention is depicted in FIGS. 2A–D. Initially, as shown in FIG. 2A, the full voltage is applied to the lamp filament for only a few microseconds, for example 20 microseconds, then turned off. At a predetermined later time, for example one second later, full voltage is once again applied for a longer time; for example 40 microseconds, then turned off again, as shown in FIG. 2B. At yet another future time interval, such as at two seconds after the initial power on cycle, the voltage is fully applied once again for an even longer period of time; for example 80 microseconds, then turned off again. At yet another future predetermined time, for example three seconds after the first cycle, full voltage is applied to the filament once again for an even greater period of time; then turned off yet again, as shown in FIG. 2C. This pattern continues until the pulse is turned on for the last time and allowed to remain on, as shown in FIG. 2D.

The entire time in which the pulse start is accomplished is preferably over a period of eight seconds, but could be any amount of time to best suit particular circumstances. The pulse is preferably increased linearly, as described in the example above, but also could be increased logarithmically. A duty cycle as described herein is the time in which each pulse is allowed to remain on relative to the total cycle time. For example, a cycle may be 60 hertz or 16,666 milliseconds. Also, less than full voltage may be applied to the lamp filament in each discrete voltage-on time period. The voltage may be ramped up in a particular embodiment of the present invention in an analogous manner that power-on time is ramped up as described above.

In one preferred embodiment of the present invention the duty cycle modulation is accomplished by a programmed microcontroller which controls a power supply that supplies the necessary voltage to start the filament. The microcontroller may be programmed in any number of ways to achieve the desired result, which would be known to one of ordinary skill in the art.

In one preferred embodiment, the lamp is used as a backlight for a liquid crystal display.

The present invention may be embodied in other specific forms without departing from its spirit or essential characteristics. The present embodiments are to be considered in all respects as illustrative and not restrictive. The scope of the present invention is indicated by the following claims rather than by the foregoing description, and all changes which come within the meaning and range of the equivalents of the claims are intended to be embraced therein.

What is claimed is:

1. A method for starting a fluorescent lamp, comprising the steps of:

initiating a voltage to a filament of the lamp for a first period of time, then discontinuing the voltage to the filament for a first interval;

applying the voltage to the filament for a second period of time, said second time exceeding said first time, then discontinuing the voltage for a second interval;

applying the voltage to the filament for a third period of time, said third time exceeding said second time, then discontinuing the voltage for a third interval; and providing the voltage to the filament for a final time and leaving the voltage on.

2. The method of claim 1, wherein the relationship between the first, second, and third periods of time during which the voltage remains on, is a linear relationship.

3. The method of claim 1, wherein the relationship between the first, second, and third periods of time during which the voltage remains on, is a logarithmic relationship.

4. The method of claim 1, wherein the total time elapsed between the initiation of said voltage for said first period of time and discontinuing said voltage for said third interval is about 8 seconds.

5. The method of claim 1, wherein the first time period is less than one second.

6. The method of claim 1, wherein the first interval is less than 1 second.

7. The method of claim 1, further comprising the step of:

providing a programmable microcontroller in association with a power supply to the lamp, to automatically accomplish the application of the voltage and the time of the intervals.

8. A method for starting a fluorescent lamp comprising the steps of:

providing voltage to the lamp in a plurality of discrete and relatively brief time periods, each time period separated from the next time period by intervals when the voltage is turned off to the lamp;

increasing the length of time of each successive discrete time period when voltage is provided to the lamp; and providing voltage to the lamp for a final and continuous operating time period.

9. The method of claim 8, wherein the voltage provided to the lamp during the discrete time periods is the same voltage provided to the lamp when the lamp is operating continuously.

* * * * *